US006872696B2

(12) United States Patent
Becker et al.

(10) Patent No.: US 6,872,696 B2
(45) Date of Patent: Mar. 29, 2005

(54) PARTICLE WITH SUBSTITUTED POLYVINYL ALCOHOL COATING

(75) Inventors: Nathaniel T. Becker, Hillsborough, CA (US); Matthew J. Flynn, Mountain View, CA (US); Mark S. Gebert, Pacifica, CA (US)

(73) Assignee: Genencor International, Inc., Palo Alto, CA (US)

( * ) Notice: Subject to any disclaimer, the term of this patent is extended or adjusted under 35 U.S.C. 154(b) by 0 days.

(21) Appl. No.: 09/954,386

(22) Filed: Sep. 12, 2001

(65) Prior Publication Data

US 2002/0103095 A1 Aug. 1, 2002

Related U.S. Application Data

(60) Provisional application No. 60/257,422, filed on Dec. 20, 2000, and provisional application No. 60/243,890, filed on Oct. 27, 2000.

(51) Int. Cl.[7] ..... C11D 3/00

(52) U.S. Cl. ..... 510/392; 510/130; 510/224; 510/392

(58) Field of Search ..... 510/130, 224, 510/392

(56) References Cited

U.S. PATENT DOCUMENTS

| | | | | | |
|---|---|---|---|---|---|
| 4,106,991 | A | | 8/1978 | Markussen et al. | 195/63 |
| 4,391,745 | A | * | 7/1983 | Denkler et al. | 510/321 |
| 4,626,372 | A | | 12/1986 | Kaufmann et al. | 252/90 |
| 4,689,297 | A | | 8/1987 | Good et al. | 435/174 |
| 4,828,744 | A | | 5/1989 | Kaufmann et al. | 252/90 |
| 4,885,105 | A | * | 12/1989 | Yang et al. | 510/296 |
| 5,096,741 | A | * | 3/1992 | Kobayashi et al. | 427/127 |
| 5,198,198 | A | * | 3/1993 | Gladfelter et al. | 422/264 |
| 5,234,617 | A | * | 8/1993 | Hunter et al. | 8/648 |
| 5,254,287 | A | * | 10/1993 | Deleeuw et al. | 252/186.27 |
| RE34,606 | E | | 5/1994 | Estell et al. | 435/222 |
| 5,324,649 | A | | 6/1994 | Arnold et al. | 435/187 |
| 5,332,527 | A | * | 7/1994 | Heinzman et al. | 252/546 |
| RE34,988 | E | | 7/1995 | Yang et al. | 252/90 |
| 5,814,501 | A | | 9/1998 | Becker et al. | 435/174 |
| 6,274,538 | B1 | * | 8/2001 | Addison | 510/224 |
| 6,294,509 | B1 | * | 9/2001 | Meiwa et al. | 510/130 |

FOREIGN PATENT DOCUMENTS

| | | |
|---|---|---|
| EP | 0 266 796 | 5/1988 |
| EP | 0 130 756 | 6/1991 |
| JP | 63305198 | 12/1988 |
| WO | WO 93/07263 | 4/1993 |
| WO | WO 93/22417 | 11/1993 |
| WO | WO 97/12958 | 4/1997 |
| WO | WO 99/32613 | 7/1999 |
| WO | WO 01/29170 A1 | 4/2001 |

OTHER PUBLICATIONS

"Enzymes in Detergency." ed Jan van Ee, et al . Chpt 15, pp 310–312 (Marcel Dekker, Inc . New York. NY (1997).

Database WPI Section Ch, Week 198904 Derwent Publications Ltd., London, GB , An 1989–029664 XP002197642.

PCT International Search Report, May 15, 2002.

* cited by examiner

*Primary Examiner*—Preeti Kumar

(74) *Attorney, Agent, or Firm*—Genencor International, Inc.

(57) ABSTRACT

The present invention provides an improved coating material for use with particles, such as enzyme granules, and the like. In particular, the present invention provides a modified PVA, as well as particles or granules that include such coating. The PVA is modified by substituting hydrophilic moieties for the hydroxyl or alcohol groups of the PVA. Substitution may be achieved with hydrophilic acids, amines, thiols, or combinations thereof.

15 Claims, 4 Drawing Sheets

PARTICLE WITH SUBSTITUTED POLYVINYL ALCOHOL COATING

RELATED APPLICATION

This application is a U.S. Provisional Application No. 60/243,890, filed Oct. 27, 2000, and U.S. Provisional Application No. 60/257,422, filed Dec. 20, 2000, all of which are hereby incorporated herein in their entirety.

FIELD OF THE INVENTION

The present invention relates to particles, such as enzyme granules, and the like. In particular, the present invention relates to coatings for such particles.

BACKGROUND

Many laundry detergents contain boron-containing compounds such as boric acid, sodium borate or sodium perborate. Sodium borate, also known as borax, is used as a builder or calcium sequestrant, improving detergency properties in hard water. Borate buffers the detergent at around pH 9–11. It also acts to stabilize pigment soil and stabilize certain enzymes such as proteases and amylases. Sodium perborate, in either the monohydrate or tetrahydrate form, is added in some detergents as a peroxygen bleach. Either alone or in combination with a bleach activator such as TAED or NOBS, perborate generates hydrogen peroxide in situ when diluted into the water of a washing machine, and the hydrogen peroxide is effective in bleaching certain oxidizable stains such as protein-based stains.

Enzymes are useful additives to laundry detergents for their efficacy in hydrolyzing and removing many different types of stains. For example, proteases, amylases and lipases remove stains based on protein, starch, and triglyceride oils. Some enzymes are useful for their benefits in modifying or restoring fabric properties. For example, cellulases can be used to remove frayed or pilled cellulose fibers to restore the color, texture and appearance of cotton-based fabrics. To achieve these benefits in powdered laundry detergents, the enzymes must be added in a granulated form. These granules or particles typically require a strong outer coating of low permeability to serve as a barrier during storage in the detergent against heat, humidity, and diffusible oxidants, such as peroxygen bleaches and hydrogen peroxide. Further, a tough or flexible outer coating can help to increase the mechanical strength and attrition-resistance of the enzyme granule. This is important in reducing the tendency of the granule to produce sensitizing protein dusts upon handling, for example in the production line of a detergent manufacturing plant. Sensitizing dusts have been known to induce allergic responses in detergent factory workers, and effective enzyme granule coatings are a principal means of reducing the levels of airborne enzyme dusts and aerosols in detergent factories.

Polyvinyl alcohol (PVA) has proven to be a very effective coating for detergent enzyme granules. Examples of the use of PVA in enzyme granule coatings can be found, for example, in U.S. Pat. No. 5,324,649. PVA is particularly useful because it simultaneously provides a coating with reduced permeability to moisture and oxidants, a strong and attrition-resistant coating, and a coating, which is readily soluble in water and detergent solutions in both cold and hot water. It is also sufficiently water soluble that it can readily be prepared in coating solutions, and coated onto enzyme-containing granules at reasonable rates, for example in fluidized bed spray-coaters. Such a coating process is described in aforementioned U.S. Pat. No. 5,324,649. PVA is available in a wide range of molecular weights and degrees of hydrolysis, allowing one skilled in the art to control the relative solubility and physical properties of the polymer coating, which can be optimized to balance factors such as the ease of coating, dissolution rate of the granule, attrition resistance of the granule, and permeability of the granule to moisture and oxidants. PVA is also readily plasticized with water, glycerol, triethylene glycol, polyethylene glycol, formamide, and triethanolamine acetate, and other polyhydric compounds, and is compatible with pigments and fillers such as titanium dioxide, talc, and calcium carbonate, and dyes.

One of the unfortunate properties of PVA, however, is its tendency to become crosslinked by a number of chemical species, including sodium borate, sodium perborate, aldehydes, and certain dyes (e.g., Protamine, Mobay Corp.). Borates, perborates and other boron-containing compounds form adducts with the vicinal hydroxyl groups of PVA at alkaline pH's, resulting in water-insoluble complexes or gels. This insolubility of the borate-PVA gels is reversible upon a shift towards more acidic pH. In addition, agitation or higher temperatures can also prevent the formation of an insoluble gel layer since dissolution and dilution of the PVA is more rapid than crosslinking of PVA under these conditions. Unfortunately, in many laundry applications, the presence of borate and the washing conditions result in the insolubilization of any PVA present in the coating or interior of enzyme granules. The PVA coating typically contains a pigment or filler such as titanium dioxide or talc, and once the coating is gelled or insolubilized, it remains as a visible shell or residue, which attaches to clothing due to its gummy nature when hydrated. These shells persist as visible residue on clothing, which is undesirable to consumers.

The crosslinking or gelation of PVA-coated granules frequently makes them unacceptable for use in borate- or perborate-containing detergents. To some extent, the degree of crosslinking can be modified by the addition into the coating of fillers or extenders, such as talc, clay, starch or maltodextrin. Blending PVA with other substances to create soluble films or pouches is described in U.S. Pat. No. 4,828,744 and U.S. Pat. No. 4,626,372. However, the PVA will still tend to cross-link even at levels as low as 10% w/w in the coating, and such a drastic reduction of PVA in the coating tends to obviate its barrier and mechanical strength properties. U.S. Pat. No. RE34,988 describes a modified PVA, dissolvable pouch containing enzymes; however, pouches typically do not provide uniform enzyme release.

Thus there is a need in the art for a particle coating having a vinyl polymer or copolymer composition sufficient to provide barrier and tensile strength properties without significant crosslinking or gelation of the vinyl polymer or copolymer in the presence of chemicals such as sodium borate, sodium perborate and other boron containing compounds.

SUMMARY OF THE INVENTION

The present invention provides a particle having a coating material comprising a substituted vinyl polymer or copolymer thereby providing low reactivity with sodium borate, sodium perborate and other boron-containing compounds while maintaining acceptable barrier, solubility and mechanical strength properties. The invention further comprises cleaning and detergent products containing sodium borate, sodium perborate or other boron-containing compounds and the particle with the substituted vinyl polymer or copolymer coating material.

In a preferred embodiment the coating material may be polyvinyl alcohol (PVA) with or without other additions such as fillers, extenders, plasticizers, pigments, dyes and the like. In this embodiment, the substitution of variable percentages of the hydroxyl or alcohol groups of the PVA is achieved using hydrophilic organic acids, amines, thiol moieties, or a combination of substitution agents. Preferred solubility of the materials utilized to make the substitution is preferably at least 100 grams per 100 ml of distilled water at 25 degrees C.

In a preferred embodiment the PVA is substituted with about 1–10% carboxylic acid. In another preferred embodiment the PVA is substituted with about 1–10% of a combination of carboxylic and sulfonic acid.

In a preferred embodiment the substituted PVA surrounds a water soluble or dispersible core with one or more enzymes. In another preferred embodiment a detergent composition comprises an enzyme particle coated with the substituted PVA and a borate compound.

The substituted PVA coatings of the present invention exhibit good barrier and mechanical strength properties without significant crosslinking or gelation with borate compounds thereby providing easily manufactured granules that may be tailored to provide selectable properties, such as dissolution rates, for applications such as detergents and other cleaning compounds.

DETAILED DESCRIPTION OF THE INVENTION

Figure 1:
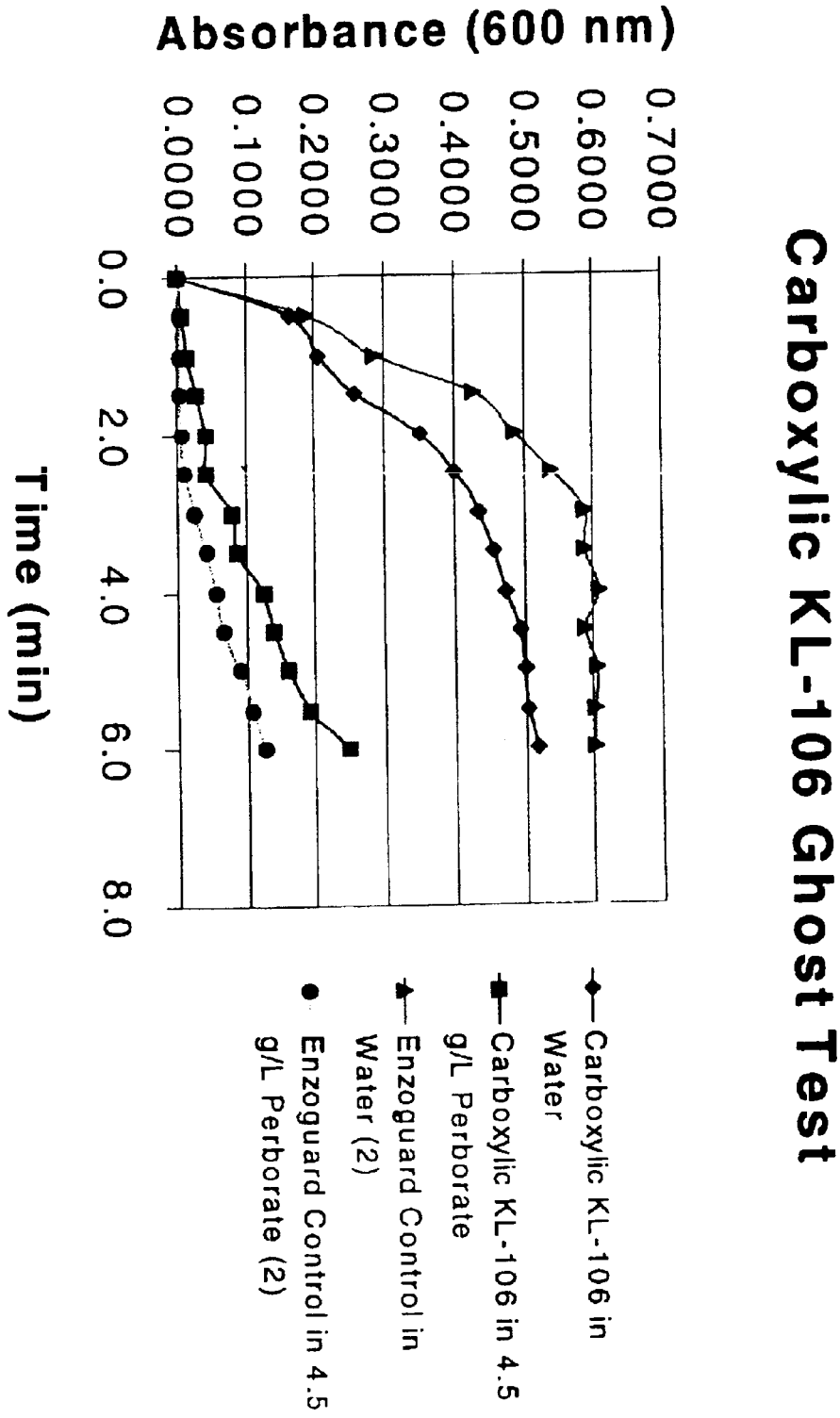
FIG. 1 is a graph showing dissolution times of 1% carboxylic acid substituted PVA coatings and a control non-substituted PVA coating.

Surprisingly, it has been found that particles or granules of the present invention coated with a material comprised of a substituted vinyl polymer or copolymer, preferable polyvinyl alcohol (PVA) exhibit low reactivity with sodium borate, sodium perborate and other boron-containing compounds. The invention provides particles or granules coated with such a substituted coating material. In one embodiment, the particle is a coated enzyme granule.

The preferred PVA is defined as a homopolymer or copolymer in which vinyl acetate is a starting monomer unit and in which most or all (70–100%) of the acetate moieties are subsequently hydrolyzed to alcohol moieties. Other vinyl polymers that may be useful in the present invention include, but are not limited to, polyvinyl acetate and polyvinyl pyrrolidone. Copolymers such as PVA-methylmethacrylate copolymer may also be used in the present invention. PVA is commercially available in a wide range of molecular weights, viscosities and varying degrees of hydrolysis from the polyvinyl acetate precursor.

It has been found by this invention that certain modifications can be made to the PVA molecule which significantly reduce or eliminate its tendency to be gelled by boron compounds such as borate and perborate, while leaving largely intact its beneficial properties as a coating for enzyme granules, such as its barrier properties, mechanical strength, and water solubility. Many modifications of PVA cited in the literature have the effect of making it less water soluble or more resistant to water, which would be undesirable for polymer used in enzyme granule coatings. Other modifications of PVA are not true modifications of PVA, but rather involve syntheses of novel polymers, such as copolymers of vinyl monomers and other monomers such as acrylic or styrene groups.

In this invention, generally the side chain alcohol or hydroxyl groups of the PVA are at least partially substituted by hydrophilic moieties, although substitutions also may occur at other locations. The term hydrophilic, in this context, is meant to describe an acid, amine, or thiol that has solubility in water of at least 100 grams per 100 mls of distilled water. Substitution is accomplished by reacting the PVA with hydrophilic acids, amines or thiols. For example, the PVA can be reacted with one of the class of carboxylic acids (for example, formic acetic, succinic, ascorbic, —COOH, and so on) to produce a carboxylated PVA, by methacryl amide to form a methacrylamido-PVA, by sulfonic or sulfuric acid to produce a sulfonated PVA, or with thiols to form a sulfhydryl-PVA. Preferred carboxylic acids are listed in Table 1, although those skilled in the art will recognize that other carboxylic acids may be utilized and the invention is not limited to those acids in Table 1. Additionally, the PVA may be reacted with a combination of sulfonate, or sulfate and carboxylate compounds to form PVA having both sulfonated and carboxylated groups Preferred concentrations of substitution moieties are between about 1 to 10%, and more preferred between about 5 to 10%. It will be recognized by those skilled in the art that the percentage of substitution moieties selected for a coating of a particle or granule properties depends upon a desired application property (e.g. dissolution rate) for the coated particle or granule.

The resulting carboxylated, sulfonated, amidated or thiolated PVA typically has better water solubility than the unsubstituted precursor, but reduced or a negligible tendency to become crosslinked by boron compounds such as borate or perborate. The tendency of granule coatings to become insolublized in the presence of perborate can be readily determined by a simple test (herein, "Ghost Test"), in which granules coated with a PVA-$TiO_2$ mixture (or a mixture of PVA with any other insoluble filler which readily absorbs light at a wavelength of 600 nm) are added to an agitated solution of sodium perborate buffer, and the rate and extent of $TiO_2$ released from the granule is measured by monitoring the turbidity of the bulk buffer solution as a function of time. Dissolution was performed with 200 mls of a 4.5-gram per liter sodium perborate monohydrate solution at room temperature with a stirring rate of 250 rpm and a beaker size of 250 ml and a stir bar length of 1 inch and diameter of 0.25 inches. The resulting turbidity curve generated for granules added to a borate buffer can then be compared to a control turbidity curve generated for granules dissolved in an aqueous solution free of borate or perborate. The ratio of the rates and equilibrium turbidities generated in the perborate and perborate-free buffers can then be taken as a measure of the tendency of the granule coating to become crosslinked or insolublized by perborate.

Herein, a material is said to exhibit low reactivity with sodium borate, sodium perborate and other boron-containing compounds if it exhibits a ratio of the optical absorbance at 600 nm in perborate solution to the absorbance at 600 nm in distilled water of greater than 25 percent at 6.0 minutes, and more preferably greater than 40 percent, and most preferably greater than 60 percent, as determined by the Ghost Test. The coatings of the present invention can be employed in connection with any number of granule or particle formulations, such as Enzoguard®.

(See U.S. Pat. No. 5,324,649; Genencor International Inc., Rochester, N.Y.) or Savinase granules (Novo Nordisk, Denmark), among others. Other exemplary granule formulations which can incorporate the teachings herein include those disclosed in, U.S. Pat. No. 4,689,297, U.S. Pat. No. 5,814,501, WO 9712958, U.S. Pat. No. 4,106,991, WO 99/32613, PCT application no. US 00/27888, and those described in "Enzymes In Detergency," ed. Jan H. van Ee, et al., Chpt. 15, pgs. 310–312 (Marcel Dekker, Inc., New York, N.Y. (1997)); all of which are expressly incorporated herein by reference.

Core materials suitable for use in the particles or granules of the present invention are preferably of a highly hydratable material, i.e., a material that is readily dispersible or soluble in water. The core material should either disperse (fall apart by failure to maintain its integrity when hydrated) or solubilize by going into a true aqueous solution. Clays (bentonite, kaolin), nonpareils and agglomerated potato starch are considered dispersible. Nonpareils are spherical particles consisting of a seed crystal that has been built onto and rounded into a spherical shape by binding layers of powder and solute to the seed crystal in a rotating spherical container. Nonpareils are typically made from a combination of a sugar, such as sucrose, and a powder, such as corn starch. Alternate seed crystal materials include sodium chloride and other inorganic salts.

Particles composed of inorganic salts and/or sugars and/or small organic molecules also may be used as the cores of the present invention. Suitable water soluble ingredients for incorporation into such cores include: sodium chloride, ammonium sulfate, sodium sulfate, urea, citric acid, sucrose, lactose and the like. Water soluble ingredients can be combined with water dispersible ingredients. Cores can be fabricated by a variety of granulation techniques including: crystallization, precipitation, pan-coating, fluid-bed coating, rotary atomization, extrusion, spheronization and high-shear agglomeration.

The cores of the granules or particles of the present invention may further comprise one or more of the following: fillers, plasticizers or fibrous materials. Suitable fillers useful in cores of the present invention include inert materials used to add bulk and reduce cost, or used for the purpose of adjusting the intended enzyme activity in the finished granulate. Examples of such fillers include, but are not limited to, water soluble agents such as urea, salts, sugars and water dispersible agents such as clays, talc, silicates, carboxymethyl cellulose or starches. Suitable plasticizers useful in the cores of the present invention are nonvolatile solvents added to a polymer to reduce its glass transition temperature, thereby reducing brittleness and enhancing deformability. Typically, plasticizers are low molecular weight organic compounds and are highly specific to the polymer being plasticized. Examples include, but are not limited to, polyols (polyhydric alcohols, for example, alcohols with many hydroxyl groups such as glycerol, ethylene glycol, propylene glycol or polyethylene glycol), polar low molecular weight organic compounds such as urea, or other known plasticizers such as dibutyl or dimethyl phthalate, or water. Suitable fibrous materials useful in the cores of the present invention include materials which have high tensile strength and which can be formed into fine filaments. Typical fibrous materials include, but are not limited to: cellulose, glass fibers, metal fibers, rubber fibers, azlon (manufactured from naturally occurring proteins in corn, peanuts and milk) and synthetic polymer fibers. Synthetics include Rayon®, Nylon®, acrylic, polyester, olefin, Saran®, Spandex® and Vinal®. Typical cellulose fibers would have an average fiber length of 160 microns with a diameter of about 30 microns.

In a granule embodiment of the present invention, the core is a water soluble or dispersible nonpareil, such as listed above, either coated by or built up from the seed crystal (nonpareil) using substituted PVA either alone or in combination with anti-agglomeration agents such as titanium dioxide, talc, or plasticizers such as sucrose or polyols. The substituted PVA may be partially hydrolyzed PVA, intermediately hydrolyzed PVA, fully hydrolyzed PVA (all as defined above), or a mixture thereof, with a low to high degree of viscosity. Preferably, the core is coated with partially hydrolyzed PVA, either alone or in combination with sucrose or such other plasticizer as known in the art. Partially hydrolyzed PVA is preferred because it results in faster dissolution and a lower amount of residue upon dissolution of the granule than fully hydrolyzed PVA. The level of substituted PVA in the granule coating may represent from about 0.5% to 20% of the weight of the final coated granule. The core of the granules of the present invention, including any coating on such core material as described above, preferably comprises between about 40–85% by weight of the entire coated granule. Although the thickness of the substituted PVA coating may be selected as desired, the coatings described herein were less than 100 um thick, for example 10–30 urn thick and 13 um thick.

In a process embodiment of the present invention, the core material, which may be any material described herein, is charged into the granulator for coating with an enzyme layer.

Any enzyme or combination of enzymes may be used in the present invention. Preferred enzymes include those enzymes capable of hydrolyzing substrates. Such enzymes, which are known as hydrolases, include, but are not limited to, proteases (bacterial, fungal, acid, neutral or alkaline), amylases (alpha or beta), lipases, cellulases and mixtures thereof. Preferred proteases are also those described in U.S. Pat. No. Re. 34,606 and EP 0 130 756, and incorporated herein by reference. Other preferred proteases are described in U.S. patent application Ser. No. 09/768,080, filed Feb. 8, 2000, titled Proteins Producing An Altered Immunogenic Response And Methods Of Making And Using The Same, describing protease mutants having an altered T-cell epitope. Preferred proteases under the trade names Multifect®, Purafect® and Properase®, are available from Genencor International, Inc. Preferred proteases are subtilisins and cellulases including, but not limited to, subtilisins produced from any Bacillus species, including mutants. Other enzymes that can be used in the present invention include oxidases, peroxidases, transferases, dehydratases, reductases, hemicellulases and isomerases, among others. One or more enzymes may be included in the formulations of the present invention.

The enzyme layer of the present invention preferably contains, in addition to the selected enzyme, a vinyl polymer, preferably PVA to delaying release of the enzyme in a desirable fashion while not causing undesirable residue. In a preferred embodiment of the present invention, the enzyme layer comprises intermediately, fully or super hydrolyzed PVA of low to medium viscosity. More preferably the PVA is fully hydrolyzed with a low degree of viscosity. Fully hydrolyzed PVA, at a level of about 0.25% to 3% of the granule weight, provides the desirable characteristic of delayed release of the enzyme to prevent immediate oxidative inactivation of the enzyme by residual wash water chlorine or to prevent inactivation by oxidation or autolysis before the release of stain peptides into the wash.

The present invention also relates to cleaning compositions containing the coated particles or granules of the invention; and especially to detergent compositions that include a boron-containing compound (e.g., sodium borate or sodium perborate). The cleaning compositions may additionally contain additives, which are commonly used in cleaning compositions. These can be selected from, but not limited to, bleaches, surfactants, builders, enzymes and bleach catalysts.

The following representative examples of the substituted PVA coatings on the particles or granules of the present invention, which are not intended to be limiting, illustrate the surprising and beneficial anti-cross linking properties of such particles or granules. The examples illustrate that a desired dissolution rate for a PVA coated particle or granule may be obtained by selecting the extent of PVA substitution in the coating.

EXAMPLES

Example 1

Dissolution of PVA and Modified PVA Granule Coatings in Perborate Buffer 1% Carboxylic Acid To test enzyme particles or granules coated with substituted PVA for insolubility due to crosslinking of the PVA coating in perborate solution the following assay or test method was developed. The method consists of monitoring the optical absorbance of light at a wavelength of 600 nm as a function of time from a test solution containing 200 mg of the granules to be tested. Dissolution was performed with 200 mls of a 4.5 g/Liter sodium perborate monohydrate solution at room temperature with a stirring rate of 250 rpm and a beaker size of 250 ml and a stir bar length of 1 inch and width of ¼ inch. A control solution containing distilled water was also used. Dissolution was indicated by a rapid development of solution turbidity from the titanium dioxide contained in the coating and was measured by a rapid increase in the absorbance of the solution at 600 nm. Crosslinking or "ghosting" of the enzyme granules was indicated by little or no development in solution turbidity as was indicated by the absorbance at 600 nm. The release in borate solution of less than about 40% of the turbidity released in distilled water is an indication of significant crosslinking or ghosting, and the release of less than 25% indicates serious ghosting, which would give rise to persistent undissolved coating residues in a wash or other dissolution application.

Shown in this example is an example of a ghosting granule containing unmodified PVA which is shown as the "Enzoguard"™ coating control in FIG. 1. One can see very little solution turbidity develop with time for this granule when it is tested in the perborate solution. The performance of this same granule in water indicates full dissolution has occurred within 3 minutes. A granule in which the PVA coating has been replaced with a 1% carboxylic acid modified PVA is also shown in this figure. Such a modified PVA is available as K-Polymer KL-106 from Kuraray. It can be seen that despite the fact that only 1% of the hydroxyl groups have been modified to the carboxylic acid group, a significant decrease in crosslinking or ghosting can be observed. This is seen by the increase in the absorbance versus time curve for the KL-106 coated sample, relative to the Enzoguard control, when the ratios of absorbances in perborate solution to absorbances in distilled water are compared. In particular, after six minutes, the absorbance ratio for the KL-106 polymer is 41.6%, whereas for the unmodified PVA in the Enzoguard control, the absorbance ratio is only 20.9%, indicating serious ghosting or crosslinking. (The small decrease in solubility observed for the Carboxylic KL-106 sample in distilled water is to be expected since the pH of distilled water is usually slightly acidic and does not present a problem for these granules).

With higher percentages of the carboxylic acid used to modify PVAs, as shown in Examples 2 and 3 below, dissolution behavior in perborate solutions further improved, surprisingly providing, in some instances, granules that dissolved faster and to a greater degree in perborate solutions as compared to water.

Example 2

Figure 2:
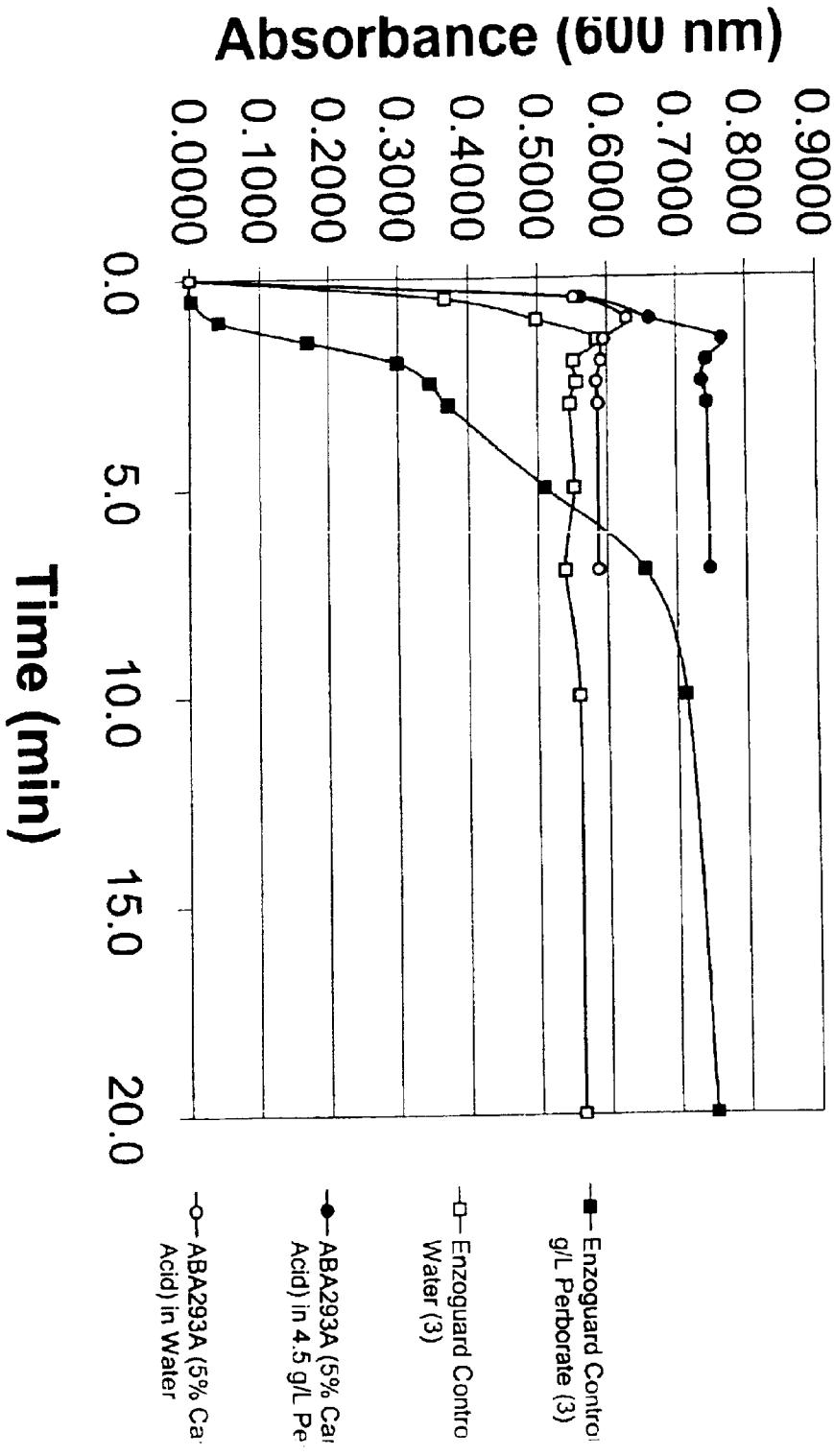
FIG. 2 is a graph showing dissolution times of 5% carboxylic acid substituted PVA coatings and a control non-substituted PVA coating.

Dissolution of PVA and Modified PVA Granule Coatings in Perborate Buffer 5% Carboxylic Acid Shown in FIG. 2, in addition to the Enzoguard controls discussed above, are results for a granule in which the PVA coating has been replaced with a 5% carboxylic acid (—COOH group) modified PVA. This substituted PVA molecule is shown in perborate and dissolved in water. Such a modified PVA is available as ABA293A from Kuraray. It can be seen that with 5% of the hydroxyl groups modified to the carboxylic acid group, crosslinking or ghosting is further reduced to a minimum level and the carboxylated PVA dissolves faster and to a greater degree in perborate than in water. This is seen by the increase in the absorbance versus time curve for the ABA293A coated sample, relative to the Enzoguard control and relative to the modified PVA in water, when the ratios of absorbances are compared. In particular, after six minutes, the absorbance of the ABA293A polymer exceeds 100% compared to the 20.9% ratio of the unmodified PVA in the Enzoguard control.

Example 3

Figure 3:
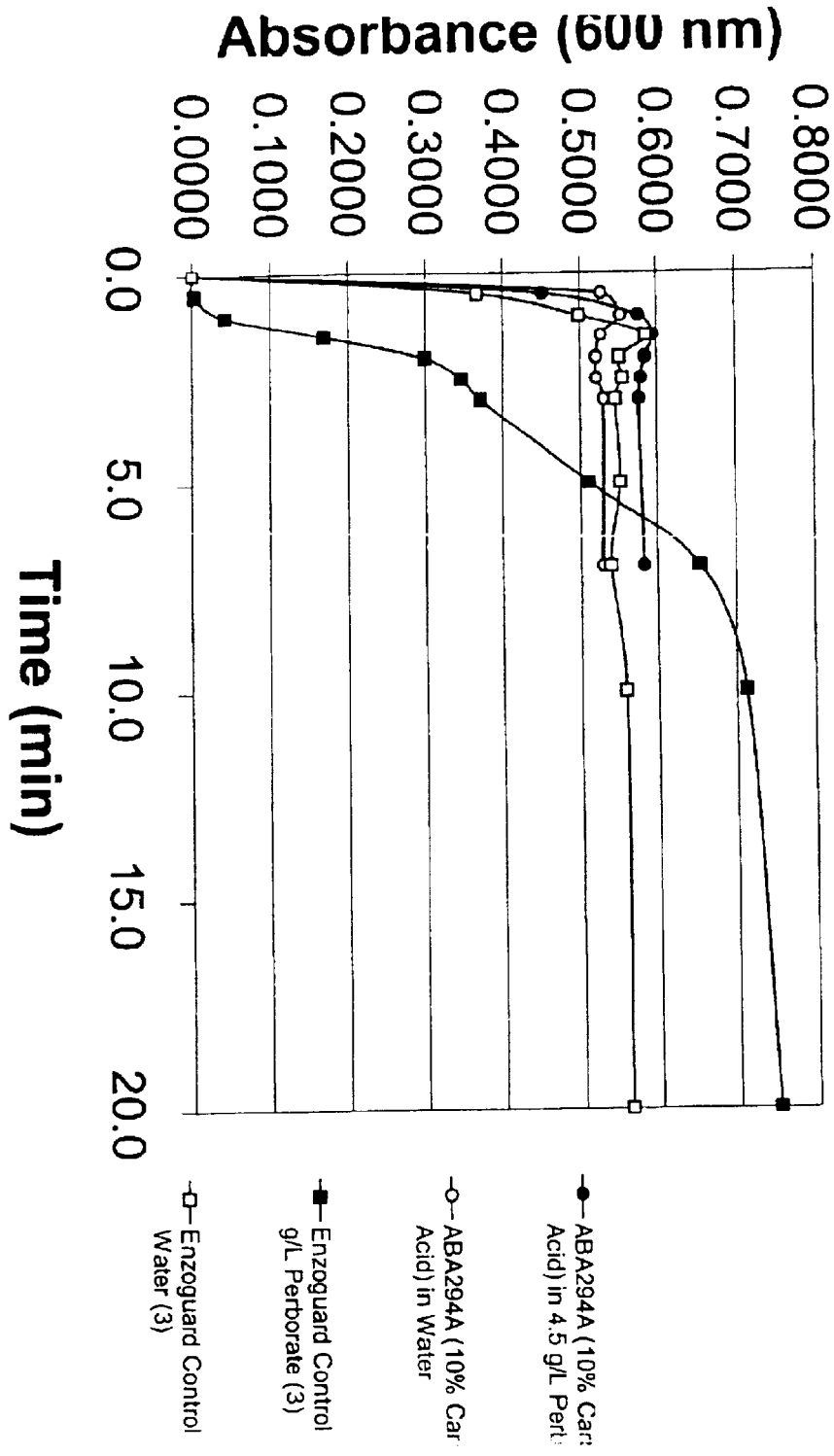
FIG. 3 is a graph showing dissolution times of 10% carboxylic acid substituted PVA coatings and a control non-substituted PVA coating.

Dissolution of PVA and Modified PVA Granule Coatings in Perborate Buffer 10% Carboxylic Acid Shown in FIG. 3, in addition to the Enzoguard controls discussed above, are results for a granule in which the PVA coating has been replaced with a 10% carboxylic acid (—COOH) modified PVA. This substituted PVA molecule is shown in perborate and dissolved in water. Such a modified PVA is available as ABA294A from Kuraray. As will be apparent in FIG. 3, the carboxylated PVA in perborate results are very similar to the results of carboxylic acid in water, having an absorbance ratio of greater than 100% compared to the 20.9% ratio of the unmodified PVA in the Enzoguard control. The carboxylated PVA, in water and in perborate, also dissolves more rapidly than the Enzoguard control. The 10% hydroxyl or alcohol group replacement results demonstrate substantial crosslinking reduction. Where manufacturing costs are an issue and higher levels of substitution are not required, the 5% hydroxyl group substitution may be preferred.

Example 4

Figure 4:
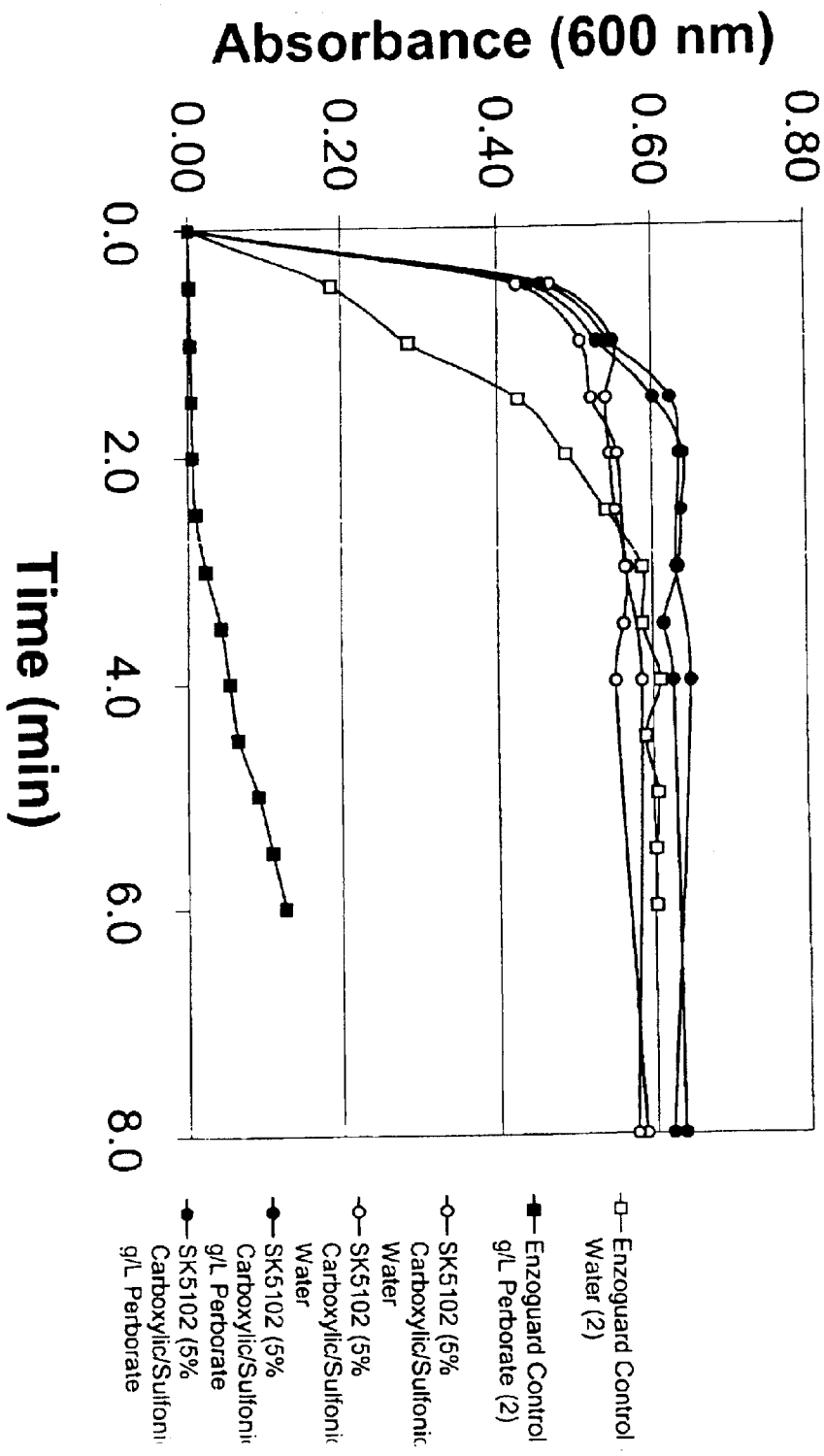
FIG. 4 is a graph showing dissolution times of a 5% combination of carboxylic/sulfonic acids used to provide a substituted PVA coating and control non-substituted PVA coating.

Dissolution of PVA and Modified PVA Granule Coatings in Perborate Buffer Carboxylic/Sulfonic Combination Shown in FIG. 4, in addition to the Enzoguard controls discussed above, are results for a granule in which the PVA coating has been replaced with a combination of carboxylic and sulfonic acids, specifically, 2.5% carboxylic acid (—COOH) and 2.5% sulfonic acid thereby constituting a 5% modified PVA. This substituted PVA molecule is shown in perborate and dissolved in water. Such a modified PVA is available as SK5102 from Kuraray. It can be seen that with 5% of the hydroxyl groups modified to the combination carboxylate and sulfonate groups, crosslinking is substantially reduced as shown by the similarity of the results in water and in perborate compared to the Enzoguard control when the ratios are compared. In particular, after six minutes, the absorbance of the SK5102 polymer is 103% compared to the 20.9% ratio of the unmodified PVA in the Enzoguard control. FIG. 4 demonstrates that combinations of substitution agents are equally useful in reducing ghosting.

Substitution Groups Suitable for Modifying PVA to Reduce Borate-Crosslinking

Hydrophilic moieties such as carboxylic and other organic acids such as sulfonic and sulfuric acids, amines, and thiol compounds are suitable choices as substituting groups for reacting with the hydroxyl groups of polyvinyl alcohol, either for partial or complete substitution. A reasonable test of hydrophilicity is the solubility of the neutral unreacted form of the compound in water. A solubility of greater than 100 grams of compound added to 100 grams water at 25 degrees C. will be taken as an indication of hydrophilicity.

The following table, Table 1, gives the solubilities of compounds, which would be suitable and unsuitable for substitution of the hydroxyl groups of PVA. Substitution can be carried out by many possible reactions, e.g., carboxylate groups can be substituted by the condensation of the acid, or direct reaction of the cyclic acid anhydride, so as to introduce the carboxylic acid group into the PVA at the locus of the original hydroxyl group. Hydrophilic acids can be substituted to introduce the acid group into the PVA at the locus of the original hydroxyl group.

TABLE I

| Compound | Solubility g/100 ml $H_2O$ | Suitable as PVA Substituent? |
|---|---|---|
| formic acid | infinite | yes |
| acetic acid | infinite | yes |
| citric acid | 145 | yes |
| maleic | infinite | yes |
| succinic | 7.7 | no |
| 2-mercaptoethanol | infinite | yes |
| ethanolamine | infinite | yes |
| ethanethiol | 0.67 | no |
| sulfuric acid | infinite | yes |
| sulfonic acid | infinite | yes |

Additionally, different substitutions may occur on a PVA molecule using a combination of compounds, such as the mixture of carboxylate and sulfonate shown and discussed in Example 4 above.

Levels of substitution as low as 1% have been found to reduce ghosting as seen in Example 1, FIG. 1. Higher levels, greater than 1% and as high as 10% for a 30,000 MW PVA compound have been found to function effectively to provide a substituted PVA compound with an acceptable solubility in perborate and other such solutions.

Various other examples and modifications of the foregoing description and examples will be apparent to a person skilled in the art after reading the disclosure without departing from the spirit and scope of the invention, and it is intended that all such examples or modifications be included within the scope of the appended claims. All publications and patents referenced herein are hereby incorporated by reference in their entirety.

What is claimed is:

1. A particle comprising a coating less than 100 um thick surrounding an enzyme core, the coating comprising a substituted PVA having a 1–100 mole% degree of substitution of hydroxyl or alcohol groups replaced with a hydrophilic organic acid, amine, thiol moiety, or combination thereof, which substituted PVA exhibits low reactivity with borate compounds.

2. The particle of claim 1 wherein the substituted PVA is a homopolymer.

3. The particle of claim 1 wherein the substituting organic acid, amine, thiol moiety, or combination thereof has a salability of at least 100 grams per 100 ml distilled water at 25 degrees C.

4. The particle of claim 2 wherein the replacement occurs at least at one side chain of the PVA.

5. The particle of claim 1 wherein the PVA is substituted by replacement of the hydroxyl or alcohol groups with sulfonic or sulfuric acid.

6. The particle of claim 1 wherein the PVA is substituted by replacement of hydroxyl or alcohol groups with a combination of carboxylate and sulfonate.

7. The particle of claim 1 wherein the PVA is substituted by replacement of about 1–10% hydroxyl or alcohol groups.

8. The particle of claim 1 wherein the enzyme core comprises a water soluble or water dispersible core and one or more enzymes.

9. A granule comprising:

water soluble or dispersible core material;

one or more enzymes; and a coating less then 100 um thick comprising PVA substituted with a hydrophilic organic acid, amine, thiol moiety, or combination thereof, wherein the substituted PVA has a degree of substitution of 1–100 mole % of hydroxyl or alcohol groups of PVA, whereby the substituted PVA exhibits low reactivity with borate compounds.

10. A detergent composition containing a boron-containing compound together with the particle of claim 1.

11. The detergent composition of claim 10 wherein the boron- containing compound is sodium borate or sodium perboate.

12. The particle of claim 8 wherein the core comprises a nonpareil surrounded by the one or more enzymes.

13. The particle of claim 12 wherein the one or more enzymes further comprises intermediately, fully or super hydrolyzed PVA.

14. The particle of claim 2 wherein the replacement occurs at hydroxyl groups of the PVA.

15. The particle of claim 1 wherein the WA is substituted by replacement of 5–10% hydroxyl or alcohol groups.

* * * * *

UNITED STATES PATENT AND TRADEMARK OFFICE

CERTIFICATE OF CORRECTION

PATENT NO. : 6,872,696 B2
DATED : March 29, 2005
INVENTOR(S) : Becker et al.

It is certified that error appears in the above-identified patent and that said Letters Patent is hereby corrected as shown below:

Column 10,
Line 19-22, should read:
The particle of claim 1 wherein the substituting organic acid, amine, thiol moiety, or combination thereof has a solubility of at least 100 grams per 100 ml distilled water at 25 degrees C.

Signed and Sealed this

Twenty-fourth Day of January, 2006

JON W. DUDAS
*Director of the United States Patent and Trademark Office*